US007716928B2

(12) United States Patent
Oda et al.

(10) Patent No.: US 7,716,928 B2
(45) Date of Patent: May 18, 2010

(54) EXTERNAL COMBUSTION ENGINE

(75) Inventors: Shuzo Oda, Kariya (JP); Shinichi Yatsuzuka, Nagoya (JP); Yasunori Niiyama, Kuwana (JP); Katsuya Komaki, Kariya (JP); Takashi Kaneko, Nagoya (JP)

(73) Assignee: Denso Corporation, Kariya (JP)

( * ) Notice: Subject to any disclaimer, the term of this patent is extended or adjusted under 35 U.S.C. 154(b) by 122 days.

(21) Appl. No.: 12/012,746

(22) Filed: Feb. 5, 2008

(65) Prior Publication Data

US 2009/0031727 A1 Feb. 5, 2009

(30) Foreign Application Priority Data

Feb. 7, 2007 (JP) ..... 2007-027848

(51) Int. Cl.
*F02G 1/04* (2006.01)
*F01K 23/06* (2006.01)
*F02C 5/00* (2006.01)

(52) U.S. Cl. ..... 60/531; 60/508; 60/516; 60/670; 60/39.6

(58) Field of Classification Search ..... 60/516–526, 60/531, 659, 670, 671, 508, 514; 138/44–46
See application file for complete search history.

(56) References Cited

U.S. PATENT DOCUMENTS 4,195,481 A * 4/1980 Gregory ..... 60/516
4,489,553 A * 12/1984 Wheatley et al. ..... 60/516
4,584,840 A * 4/1986 Baumann ..... 62/6
6,931,852 B2 * 8/2005 Yatsuzuka et al. ..... 60/670
7,415,824 B2 * 8/2008 Komaki et al. ..... 60/508

* cited by examiner

*Primary Examiner*—Thomas E. Denion
*Assistant Examiner*—Christopher Jetton
(74) *Attorney, Agent, or Firm*—Harness, Dickey & Pierce, PLC

(57) ABSTRACT

An external combustion engine includes: a main container sealed with a working fluid in a liquid state adapted to flow; a heater for heating a portion of the working fluid in the main container and generating the vapor of the working fluid; a cooler for cooling and liquefying the vapor; an output unit for outputting by converting the displacement of the liquid portion of the working fluid generated by the volume change of the working fluid due to the generation and liquefaction of the vapor into mechanical energy; and an auxiliary container communicating with the main container. The heater, the cooler and the output unit are arranged in order, in the direction of displacement of the working fluid. The working fluid is sealed in the auxiliary container which communicates with the portion of the main container nearer the output unit than the cooler. The engine further includes a communication area adjusting unit for establishing communication between the main container and the auxiliary container with a first communication area in normal operation mode and with a second communication area larger than the first communication area at the time of engine start. Thus, a predetermined output is produced quickly after engine start.

9 Claims, 12 Drawing Sheets

EXTERNAL COMBUSTION ENGINE

BACKGROUND OF THE INVENTION

1. Field of the Invention

This invention relates to an external combustion engine for converting the displacement of a liquid portion of a working fluid caused by a volume change of the working fluid due to the generation and liquefaction of the vapor of the working fluid into mechanical energy and then outputting the mechanical energy.

2. Description of the Related Art

One type of external combustion engine is known to have the configuration in which a working fluid in a liquid state is sealed in a pipe-like container, the vapor of the working fluid is generated by heating part of the working fluid in the container by a heater, the vapor of the working fluid is cooled and liquefied by a cooler to thereby change the volume of the whole working fluid, and the displacement of the liquid portion of the working fluid generated by the volume change of the working fluid is converted into mechanical energy and then outputted (See, for example, Japanese Unexamined Patent Publication No. 2005-330910).

In the above technique, the heater is arranged above the cooler, and when part of the working fluid is heated by the heater, the high-temperature high-pressure vapor of the working fluid is accumulated on the portion of the container where the heater is arranged, so that the liquid level of the working fluid is pushed down toward the cooler. As a result, the liquid portion of the working fluid is displaced downward in the container.

The vapor of the working fluid, advancing into the portion of the container where the cooler is arranged, is cooled and liquefied by the cooler. Therefore, the force to push down the liquid level of the working fluid is lost, and the liquid level of the working fluid rises into the heater, and the liquid portion of the working fluid is displaced upward. By repeating this operation, the liquid portion of the working fluid is moved and displaced periodically. In the process, the internal pressure of the container changes periodically.

Japanese Patent Application No. 2006-78802 (hereinafter referred to as the prior application) proposes an external combustion engine improved in output and efficiency. This prior application is intended to improve the output and efficiency of the external combustion engine by controlling the average value of the internal pressure of a container toward a target value.

More specifically, the working fluid in a liquid state is sealed in an auxiliary container separate from a main container sealed with the working fluid, the main container and the auxiliary container communicate with each other through a choke, and the working fluid in the auxiliary container is compressed or expanded by a piston mechanism thereby to control the internal pressure of the auxiliary container.

In this configuration, since the main container and the auxiliary container communicate with each other through the choke, the internal pressure of the auxiliary container does not change periodically with the internal pressure of the main container, and can be stabilized at a level substantially equal to the average value of the internal pressure of the main container. Thus, a target value of the internal pressure of the main container is calculated based on the temperature of a heater, etc., and the internal pressure of the auxiliary container is controlled toward the target value by a piston mechanism. As a result, the average value of the internal pressure of the main container near the target value can be obtained.

According to the prior application described above, in the case where the external combustion engine stops and the heater stops heating the working fluid, the temperature of the heater gradually drops to ambient temperature. As long as the vapor of the working fluid is accumulated in the main container when the external combustion engine stops; however, the saturated vapor pressure of the working fluid also drops with the heater temperature, resulting in condensation and liquefaction of the vapor of the working fluid. Thus, the internal pressure of the main container drops.

Once the internal pressure of the main container drops below the internal pressure of the auxiliary container, the working fluid in the auxiliary container gradually begins to flow into the main container through the choke, and the volume of the working fluid in the main container increases excessively. This phenomenon is more likely to occur in winter when the ambient temperature is low.

In the case where the external combustion engine is restarted and the working fluid is heated by the heater with an excessive volume of the working fluid in the main container as described above, part of the working fluid is gasified and the internal pressure of the main container rises. Once the internal pressure of the main container increases beyond the internal pressure of the auxiliary container, the excess working fluid in the main container is returned to the auxiliary container through the choke.

Since only a small amount of the working fluid can flow through the choke at a time, considerable time is required before all of the excess working fluid in the main container returns to the auxiliary container. As a result, a predetermined output cannot be produced, before all of the excess working fluid in the main container can return to the auxiliary container after the engine restarts, thereby posing the problem that the restarting time is lengthened before the predetermined output is obtained.

In order to avoid the above engine restart problem, the external combustion engine is required to be stopped at a when the vapor of the working fluid is not accumulated in the main container, thereby greatly complicating the operation to stop the external combustion engine.

SUMMARY OF THE INVENTION

In view of the points described above, the object of this invention is to provide an external combustion engine capable of producing a predetermined output quickly after engine start.

In order to achieve this object, according to a first aspect of the invention, there is provided an external combustion engine comprising:

a main container (11) containing a working fluid (12) adapted to flow in liquid state;

a heater (13) for heating part of working fluid (12) in main container (11) and generating the vapor of working fluid (12);

a cooler (14) for cooling and liquefying the vapor;

an output unit (1) for converting the displacement of the liquid portion of the working fluid (12) caused by the volume change of the working fluid (12) due to the generation and liquefaction of the vapor into mechanical energy and outputting the mechanical energy; and auxiliary containers (16, 1*a*) communicating with the main container (11);

wherein the heater (13), the cooler (14) and the output unit (1) are arranged in that order in the direction of displacement of the working fluid (12);

wherein the auxiliary containers (16, 1*a*) containing the working fluid (12);

wherein the auxiliary containers (16, 1*a*) communicate with the portion of the main container (11) nearer the output unit (1) than the cooler (14);

the external combustion engine further comprising communication area adjusting means (17*a*, 15*b*, 25, 26, 30, 21, 32) for establishing the communication between the main container (11) and the auxiliary containers (16, 1*a*) through a first communication area in normal operation mode and through a second communication area larger than the first communication area in starting mode.

In this configuration, the excess working fluid (12) in the main container (11) can be quickly returned to the auxiliary containers (16, 1*a*) in starting mode, and therefore, a predetermined output can be produced quickly after the engine start.

The wording "starting mode" herein is defined as the time before a predetermined output is produced after the engine start.

According to a second aspect of the invention, there is provided an external combustion engine, wherein the communication area adjusting means includes a choke (17*a*, 15*b*) for establishing communication between the main container (11) and the auxiliary containers (16, 1*a*) in normal operation mode, and a path (25) larger in flow path area than the choke (17*a*, 15*b*) for establishing communication between the main container (11) and the auxiliary containers (16, 1*a*) in starting mode.

According to a third aspect of the invention, there is provided an external combustion engine, wherein the path (25) has a check valve (26) for allowing the working fluid (12) to flow from the main container (11) to the auxiliary containers (16, 1*a*) and blocking the reverse flow of the working fluid (12) from the auxiliary containers (16*a*, 1*a*) to the main container (11), and therefore, the working fluid (12) in the auxiliary containers (16, 1*a*) is prevented from flowing back into the main container (11) through the path (25) and the volume of the working fluid (12) in the main container (11) from increasing excessively in normal operation mode.

According to a fourth aspect of the invention, there is provided an external combustion engine, wherein the check valve (26) is a spring-type check valve including a spring portion (26*a*), wherein the spring constant of the spring portion (26*a*) is adapted to change with temperature and the working pressure ($\Delta P$) of the check valve (26) changes with the spring constant, and wherein the spring portion (26*a*) is heated by a heating means (31) controlled by a control means reducing the working pressure ($\Delta P$) in starting mode below the level thereof in normal operation mode.

In this configuration, the working fluid (12) in the auxiliary containers (16, 1*a*) is prevented from flowing into the main container (11) through the path (25) in normal operation mode while at the same time facilitating the engine starting operation by suppressing the working pressure of the check valve (26) to a low level in starting mode.

According to a fifth aspect of the invention, there is provided an external combustion engine, wherein the communication area adjusting means includes a valve (30) for opening/closing the path (25) and a control means (21) for controlling the operation of the valve (30) so as to be in a closed state in normal operation mode and to be in an open state in starting mode.

According to a sixth aspect of the invention, there is provided an external combustion engine, wherein the communication area adjusting means includes a variable choke mechanism (32) for establishing communication between the main container (11) and the auxiliary containers (16, 1*a*) and a control means (21) for controlling the variable choke mechanism (32) in such a manner as to increase the opening degree of the variable choke mechanism (32) in starting mode beyond the opening degree in normal operation mode.

According to a seventh aspect of the invention, there is provided an external combustion engine comprising a main container includes a first container (11), a second container (33) having the same configuration as the first container (11) and one auxiliary container (16) communicating with the first container (11) and the second container (33).

In this configuration, one auxiliary container (16) is shared by two external combustion engines, and therefore, the number of the auxiliary containers (16) can be reduced for a lower cost.

According to an eighth aspect of the invention, there is provided an external combustion engine, wherein the output unit (1) includes a casing (1*a*) containing the working fluid (12), and the casing (1*a*) makes up an auxiliary container.

In this configuration, the auxiliary container can be integrated with the output unit (1), and therefore, cost can be reduced.

According to a ninth aspect of the invention, there is provided an external combustion engine, wherein the output unit (1) includes a casing (1*a*) containing the working fluid (12), a cylinder (15*a*) for establishing communication between the casing (1*a*) and the main container (11) and a piston (15) supported slidably in the cylinder (15*a*) and driven by the displacement of the working fluid (12), wherein the casing (1*a*) makes up an auxiliary container and a minuscule clearance (15*b*) formed between the piston (15) and the cylinder (15*a*) makes up a choke.

In this configuration, the choke can be configured of the existing piston (15) and the cylinder (15*a*), and no separate choke is required for a lower cost.

The reference numerals inserted in the parentheses followed by the names of the respective means described in this column and the appending claims indicate the correspondence with the specific means included in the embodiments described later.

The present invention may be more fully understood from the description of the preferred embodiments of the invention, as set forth below, together with the accompanying drawings.

BRIEF DESCRIPTION OF THE DRAWINGS

FIGS. 3A, 3B and 3C are PV diagrams of the external combustion engine according to the first embodiment, in which FIG. 3A shows the ideal state, FIG. 3B the state in which the peak value of the internal pressure of the main container is lower than the saturated vapor pressure, and FIG. 3C the state in which the peak value of the internal pressure of the main container is higher than the saturated vapor pressure.

FIGS. 4A and 4B are diagrams explaining the problems posed by the external combustion engine described in Japanese Unexamined Patent Publication No. 2005-330910, in which FIG. 4A shows the state in which the volume of the working fluid is reduced and FIG. 4B the state in which the volume of the working fluid is increased.

DESCRIPTION OF THE PREFERRED EMBODIMENTS

First Embodiment

Figure 1:
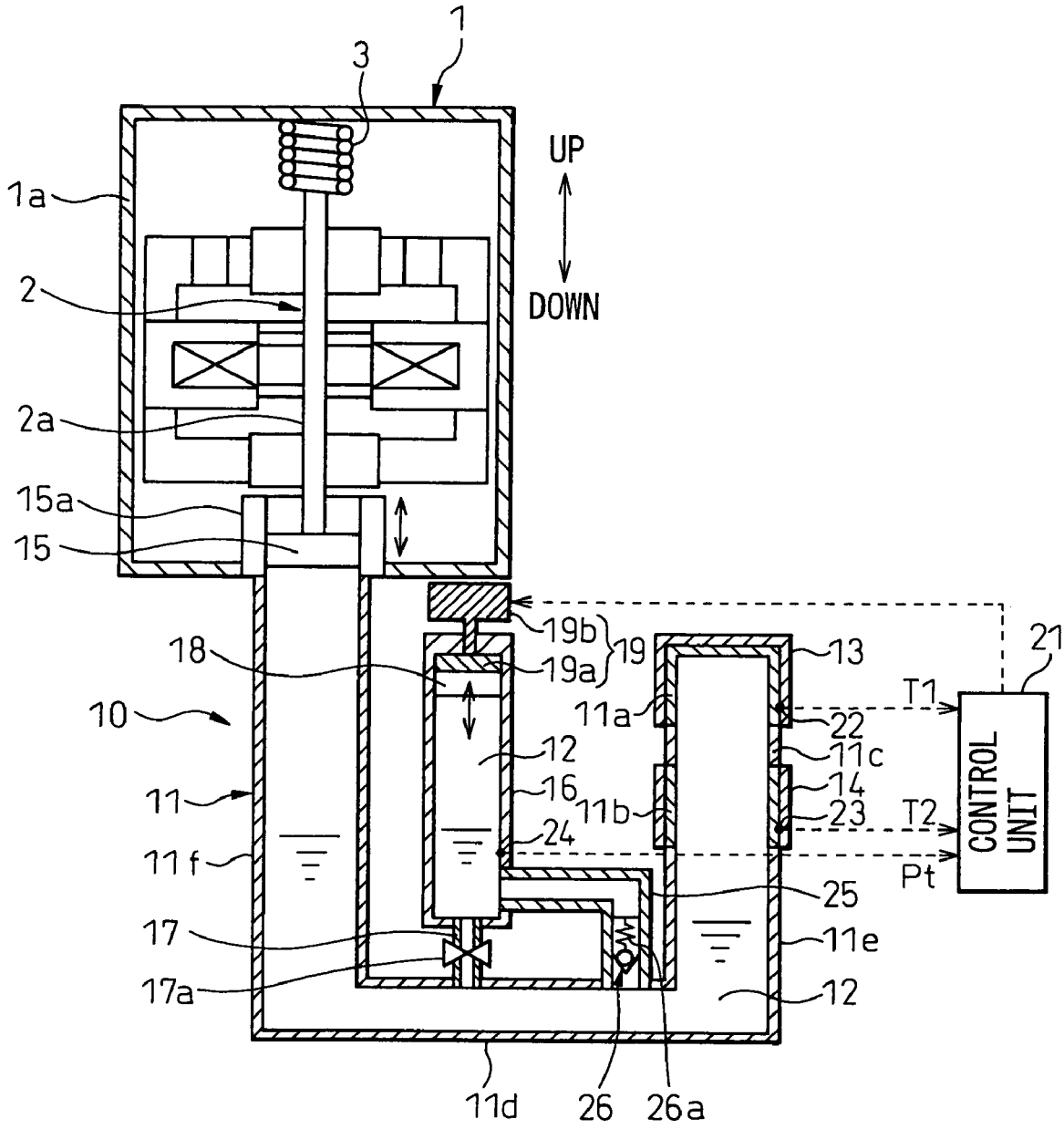
FIG. 1 is a diagram showing a general configuration of a power generating system according to a first embodiment of the invention.

A first embodiment is explained below with reference to FIGS. 1 to 7. In this embodiment, the external combustion engine 10 according to the invention is used for a power generating system. FIG. 1 is a diagram showing a general configuration of the power generating system according to this embodiment. The basic configuration of this power generating system is similar to that of the prior application described above, and therefore, the configuration in common with the prior application is explained below first.

The external combustion engine 10 according to this embodiment drives a power generator 1 for generating the electromotive force by vibratory displacement of a movable member 2 with a permanent magnet buried therein, and includes a main container 11 sealed with a working fluid 12 adapted to flow in liquid state, a heater 13 for heating and gasifying the working fluid 12 in the main container 11 and a cooler 14 for cooling the vapor of the working fluid 12 heated and gasified by the heater 13. According to this embodiment, water is used as the working fluid 12, and a refrigerant may alternatively be used.

The heater 13 according to this embodiment exchanges heat with a high-temperature gas (such as an automotive exhaust gas) and may be configured of an electric heater. Also, the cooling water is circulated in the cooler 14 according to this embodiment. Though not shown, a radiator for radiating heat absorbed from the vapor of the working fluid 12 by the cooling water is arranged in the cooling water circulation circuit.

The portion of the main container 11 in contact with the heater 13, i.e. a heated portion 11*a* and the portion of the main container 11 in contact with the cooler 14, i.e. a cooled portion 11*b* are desirably formed of a material high in heat conductivity. According to this embodiment, the heated portion 11*a* and the cooled portion 11*b* are formed of copper or aluminum. Incidentally, the heated portion 11*a* may be formed integrally with the heater 13, and so may the cooled portion 11*b* with the cooler 14.

The intermediate portion 11*c* of the main container 11 between the heated portion 11*a* and the cooled portion 11*b*, on the other hand, is desirably formed of a material high in thermal insulation. According to this embodiment in which water is used as the working fluid 12, the intermediate portion 11*c* is formed of stainless steel. Similarly, the portion of the main container 11 nearer the power generator 1 than the cooled portion 11*b* is formed of stainless steel high in thermal insulation.

The main container 11 is a pressure vessel formed in a substantially U-shaped pipe including a bent portion 11*d* located at the bottom thereof and first and second linear portions 11*e*, 11*f* extending vertically. The heater 13 and the cooler 14 are arranged on the first linear portion 11*e* at one horizontal end (right side in FIG. 1) of the main container 11 beyond the bent portion 11*d*. The heater 13 is located above the cooler 14.

Though not shown, in order to secure the space for gasifying the working fluid 12, a gas (air, for example) of a predetermined volume is sealed at the upper end of the first linear portion 11*e*.

On the other hand, a power generator 1 is arranged on the top of the second linear portion 11*f* of the main container 11 at the other horizontal end (left side in FIG. 1) beyond the bent portion 11*d*. In the casing 1*a* of the generator 1 has a piston 15 slidably arranged in a cylinder 15*a*. The piston 15 is adapted to be displaced under the pressure applied from the liquid portion of the working fluid 12. Incidentally, the power generator 1 corresponds to the output unit according to the invention.

The piston 15 is coupled to the shaft 2*a* of the movable member 2 in the casing 1*a* of the power generator 1. A spring 3 constituting an elastic means for generating the elastic force to press the movable member 2 toward the piston 15 is arranged on the other side of the movable member 2 far from the piston 15.

An auxiliary container 16 for adjusting the internal pressure Pc of the main container 11 (hereinafter referred to as the main container internal pressure Pc) is arranged above the bent portion lid of the main container 11. The bent portion 11*d* and the bottom of the auxiliary container 16 communicate with each other through a first connection pipe 17. The internal volume of the auxiliary container 16 is smaller than that of the main container 11.

In order to stabilize the internal pressure Pt of the auxiliary container 16 (hereinafter referred to as the auxiliary container internal pressure Pt) at a level substantially equal to the average value Pca (described in detail later) of the main container internal pressure Pc, a choke 17*a* is arranged in the first connection pipe 17. According to this embodiment, the choke 17*a* is formed by reducing the diameter of the path in the first connection pipe 17.

The lower internal part of the auxiliary container 16 is filled with the working fluid 12 in liquid state, and the upper internal part thereof with a gas 18. The gas 18 is desirably insoluble in the working fluid 12, and according to this embodiment, formed of helium hard to solve in water. Incidentally, the auxiliary container 16 may alternatively be filled with only the working fluid 12 in liquid state.

The auxiliary container 16 and the first connection pipe 17 are desirably formed of a material high in thermal insulation, and according to this embodiment, formed of stainless steel.

The piston mechanism 19 making up the pressure regulation mechanism for adjusting the auxiliary container internal pressure Pt is configured of a pressure regulation piston 19*a* and an electrically-operated actuator 19*b*.

The pressure regulation piston 19*a* is arranged at the upper end in the auxiliary container 16, and adapted to reciprocate vertically by the electrically-operated actuator 19*b* arranged on the outside of the auxiliary container 16.

Next, the electronic control unit according to this embodiment will be briefly explained. The control unit 21 is configured of a well-known microcomputer including a CPU, a ROM and a RAM and peripheral circuits, and corresponds to the control means according to this invention.

The control unit 21, in order to control the piston mechanism 19, is supplied with detection signals from a heated portion temperature sensor 22 for detecting the temperature T1 of the heated portion 11*a* (hereinafter referred to as the heated portion temperature), a cooled portion temperature sensor 23 for detecting the temperature T2 of the cooled portion 11*b* (hereinafter referred to as the cooled portion temperature) and a pressure sensor 24 for detecting the auxiliary container internal pressure Pt. The control unit 21 is adapted to control the drive operation of the electrically-operated actuator 19*b* based on the detection signals from the sensors 22 to 24.

To produce a predetermined output quickly after engine start, this embodiment is different from the prior application in the following points.

Specifically, this embodiment includes a communication area adjusting means for adjusting the communication area between the main container 11 and the auxiliary container 16. The communication area adjusting means is configured of a second connection pipe 25 for establishing communication between the main container 11 and the auxiliary container 16, a check valve 26 arranged in the second connection pipe 25, and the first connection pipe 17 and the choke 17*a* described above.

More specifically, the second connection pipe 25 establishes the communication between the bent portion lid of the main container 11 and the lower portion of the auxiliary container 16 where the working fluid 12 exists in liquid state. Also, the flow path area of the second connection pipe 25 is larger than that of the choke 17*a*. According to this embodiment, the second connection pipe 25 is formed of stainless steel like the first connection pipe 17. Incidentally, the second connection pipe 25 corresponds to the path according to this invention.

The check valve 26 is configured to permit the flow of the working fluid 12 from the main container 11 to the auxiliary container 16, not to permit the flow from the auxiliary container 16 to the main container 11 in the second connection pipe 25. In this embodiment, the spring check valve having a spring 26*a* is adopted as the check valve 26.

The check valve 26 is adapted to open only in the case where the difference between the main container internal pressure Pc and the auxiliary container internal pressure Pt is not lower than a predetermined pressure (hereinafter referred to as the working pressure) ΔP. According to this embodiment, the working pressure ΔP is set to a level higher than the difference between the maximum value Pcmax of the main container internal pressure Pc in operation (hereinafter referred to as the maximum operating pressure) and the minimum value Ptmin of the auxiliary container internal pressure Pt (ΔP>Pcmax−Ptmin) at the time of operation.

Incidentally, the minimum value Ptmin of the auxiliary container internal pressure Pt is defined as the auxiliary container internal pressure Pt with the pressure regulation piston 19*a* operated at the uppermost position in FIG. 1.

Figure 2:
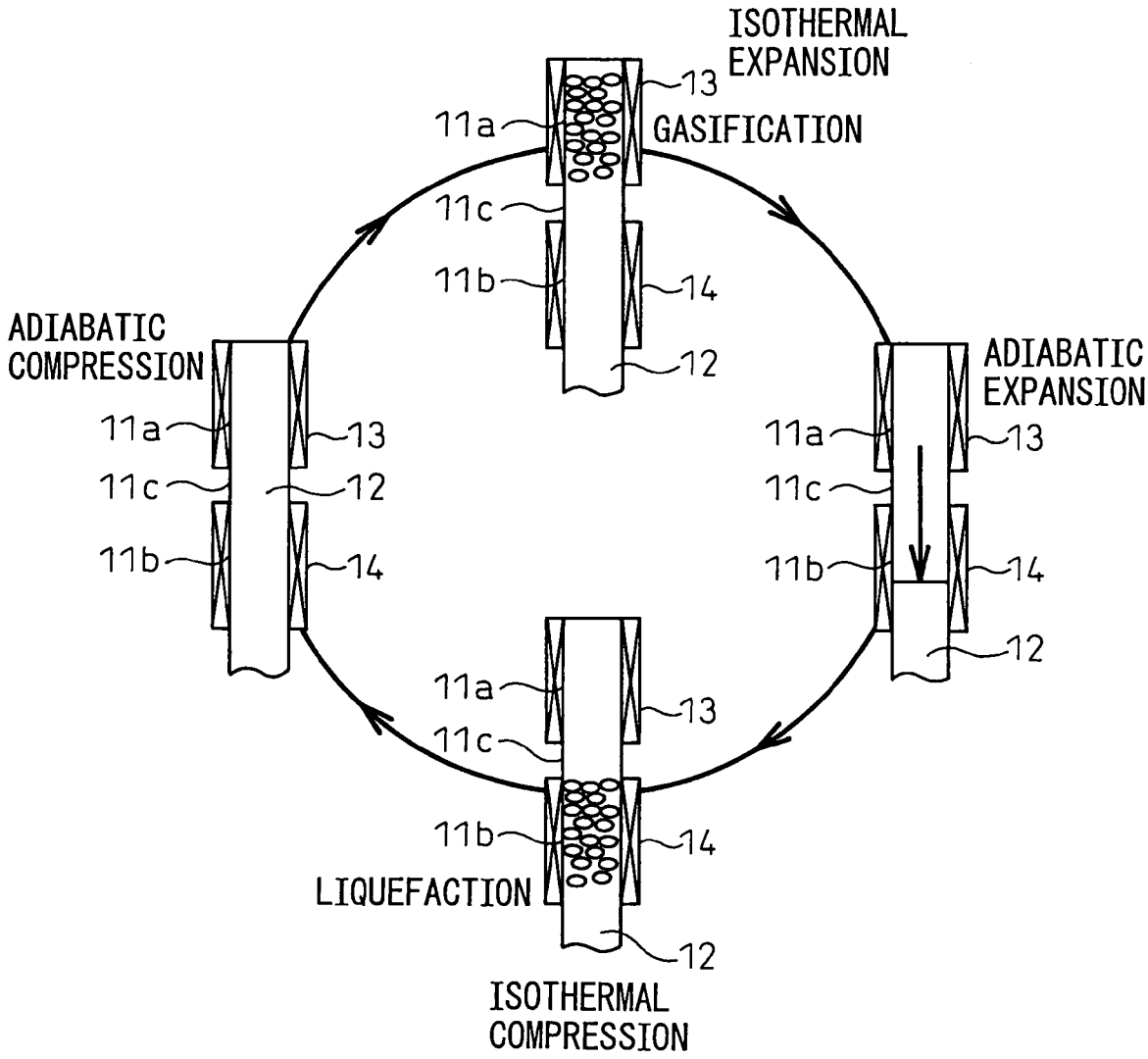
FIG. 2 is a diagram explaining the operation characteristics of an external combustion engine according to the first embodiment.

Next, the operation with this configuration will be explained with reference to FIG. 2. Upon actuation of the heater 13 and the cooler 14, the working fluid (water) in the heated portion 11*a* is heated and gasified by the heater 13, and the high-temperature high-pressure vapor of the working fluid 12 is accumulated in the heated portion 11*a* thereby to push down the liquid level of the working fluid 12 in the first linear portion 11*e* of the main container 11.

Then, the liquid portion of the working fluid 12 in the main container 11 is displaced from the first linear portion 11*e* toward the second linear portion 11*f* and pushes up the piston 15 near to the power generator 1. In the process, the spring 3 is compressed and elastically deformed by the piston 15.

The liquid level of the working fluid 12 in the first linear portion 11*e* drops to the cooled portion 11*b*, and with the advance of the vapor of the working fluid 12 into the cooled portion 11*b*, the vapor is cooled into liquid state by the cooler 14 thereby to extinguish the force to push down the liquid level of the working fluid 12 in the first linear portion 11*e*.

As a result, the piston 15 near the power generator 1 which has been pushed up by the expansion of the vapor of the working fluid 12 drops due to the elastic restitutive force of the spring 3, and the liquid portion of the working fluid 12 in the main container 11 is displaced from the second linear portion 11*f* to the first linear portion 11*e*, resulting in the rise of the liquid level in the first linear portion 11*e*.

This operation is repeated until the heater 13 and the cooler 14 stop operating. In the meantime, the liquid portion of the working fluid 12 in the main container 11 is periodically displaced (in what is called the self-excited vibration), and the movable member 2 of the power generator 1 is moved up and down.

Figure 3A:
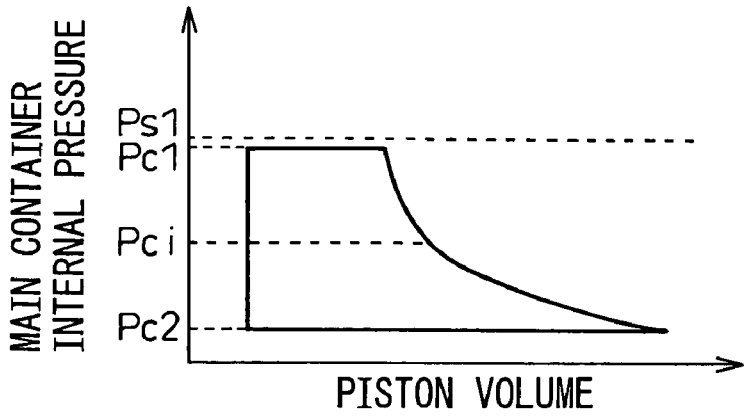

The relationship between the peak value Pc1 of the main container internal pressure Pc and the performance (output and efficiency) of the external combustion engine 10 will now be explained. FIG. 3A is a PV diagram in a given state of the external combustion engine 10.

In this PV diagram, the abscissa represents the volume of the space defined by the main container 11 and the piston 15 (hereinafter referred to as the piston volume), which is changed with the reciprocal motion of the piston 15. The abscissa of the PV diagram shown in FIGS. 3B and 3C also represent such a volume.

The PV diagram of FIG. 3A represents the case in which the peak value Pc1 of the main container internal pressure Pc is lower than the saturated vapor pressure Ps1 of the working fluid 1 at the heated portion temperature T1 and as nearest to the saturated vapor pressure Ps1. This represents the ideal state in which the work done by the external combustion engine 10 per period is maximum and the performance of the external combustion engine 10 is highest.

Figure 3B:
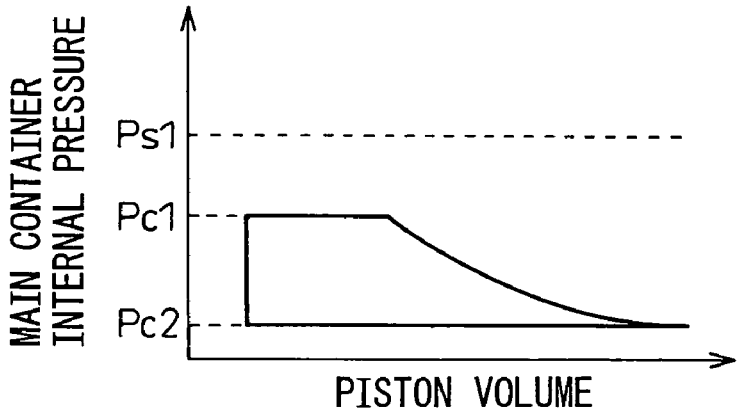

FIG. 3B, on the other hand, is the PV diagram in the state in which the peak value Pc1 is very low as compared with the saturated vapor pressure Ps1. In this state, the work done per period is decreased, and therefore, the performance of the external combustion engine 10 is also decreased.

Figure 3C:
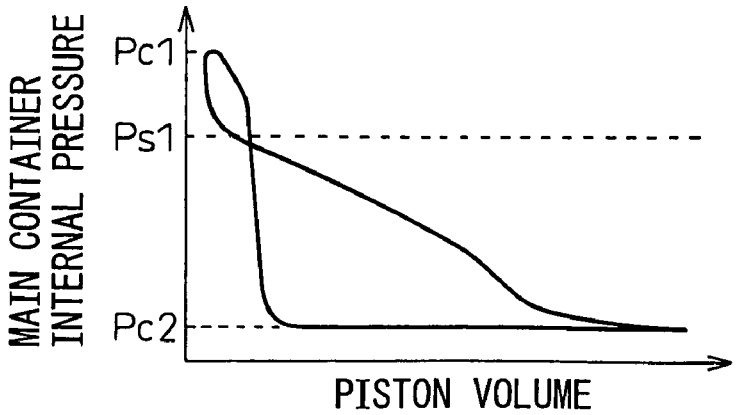

The PV diagram of FIG. 3C shows the case in which the peak value Pc1 is higher than the saturated vapor pressure Ps1. Specifically, with the increase in the heated portion temperature T1, the high-temperature vapor exists in the heater 12 even in the case where the piston 15 is located at the top dead center (the uppermost position in FIG. 1) where the piston volume is maximum.

In the process, with the movement of the piston 15 from the top dead center toward the bottom dead center (the lowest position in FIG. 1) and the resulting reduction in piston volume, the vapor of the working fluid 12 is compressed and the main container internal pressure Pc rises. Also, in view of the fact that the liquid portion of the working fluid 12 advancing into the heated portion 11*a* is heated and gasified, the main container internal pressure Pc further rises. As a result, the peak value Pc1 exceeds the saturated vapor pressure Ps1.

As long as the peak value Pc1 is higher than the saturated vapor pressure Ps1 as described above, the vapor of the working fluid 12 is partially condensed into liquid state. As a result, the work for moving down the piston 15, i.e. the negative work is done undesirably, resulting in a deteriorated performance of the external combustion engine 10.

In order to secure the maximum performance of the external combustion engine 10, therefore, the peak value Pd1 of the main container internal pressure Pc is required to be kept lower than the saturated vapor pressure Ps1 of the working fluid 12 at the heated portion temperature T1 while at the same time maintaining a value as near to the saturated vapor pressure Ps1 as possible.

With the change in the heated portion temperature T1, however, the saturated vapor pressure Ps1 of the working fluid 12 changes (as described later with reference to FIG. 7). The peak value Pc1 of the main container internal pressure Pc also changes with the heated portion temperature T1 and the temperature T2 of the cooled portion 11*b* (hereinafter referred to as the cooled portion temperature) and the leakage of the working fluid 12 from the main container 11.

Specifically, the reduction in the temperature of the high-temperature gas providing the heat source of the heater 13 or the reduction in the temperature of the cooling water circulating in the cooler 14 reduces the heated portion temperature T1 and the cooled portion temperature T2. The resulting reduction in the temperature of the liquid portion of the working fluid 12 thermally compresses and reduces the volume of the liquid portion of the working fluid 12. The gradual leakage of the working fluid 12 from the main container 11 also reduces the volume of the liquid portion of the working fluid 12.

Figure 4A:
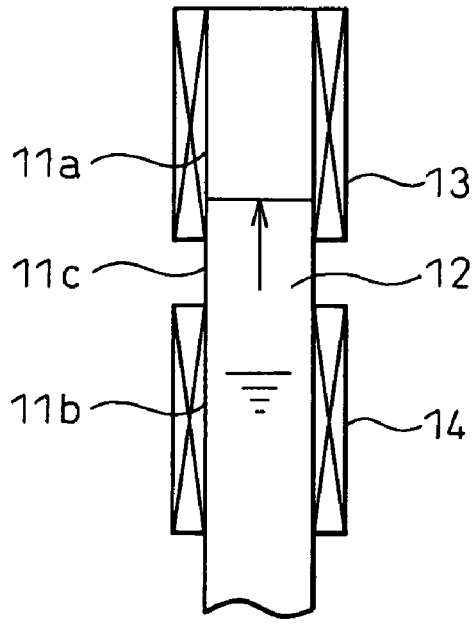

With the decrease in the volume of the liquid portion of the working fluid 12, as shown in FIG. 4A, the liquid-phase working fluid 12 fails to advance sufficiently into the heated portion 11*a* even in the case where the piston 15 is located at the bottom dead center and the piston volume is minimum.

As a result, the gasification of the working fluid 12 in the heated portion 11*a* is suppressed, and the peak value Pc1 of the main container internal pressure Pc is reduced.

Figure 4B:
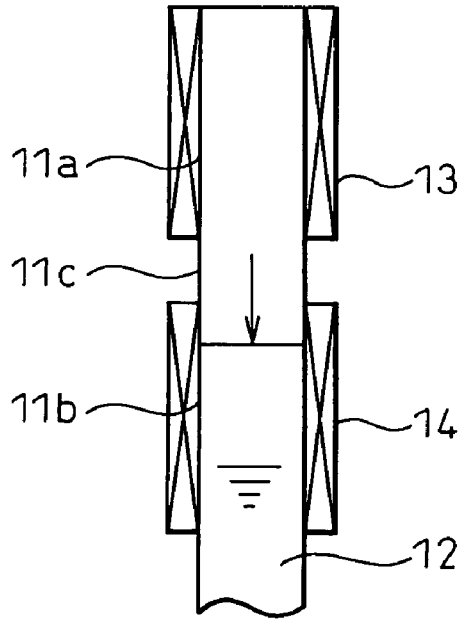

With the increase in the heated portion temperature T1 and the cooled portion temperature T2, on the other hand, the liquid portion of the working fluid 12 is thermally expanded and increases in volume. With the increase in the volume of the liquid portion of the working fluid 12, as shown in FIG. 4B, the vapor of the working fluid 12 fails to advance sufficiently into the cooled portion 11*b* even in the case where the piston 15 is located at the top dead center and the piston volume is maximum.

As a result, the liquefaction of the vapor of the working fluid 12 in the cooled portion 11*b* is suppressed, thereby increasing the peak value Pc1 of the main container internal pressure Pc.

Figure 5:
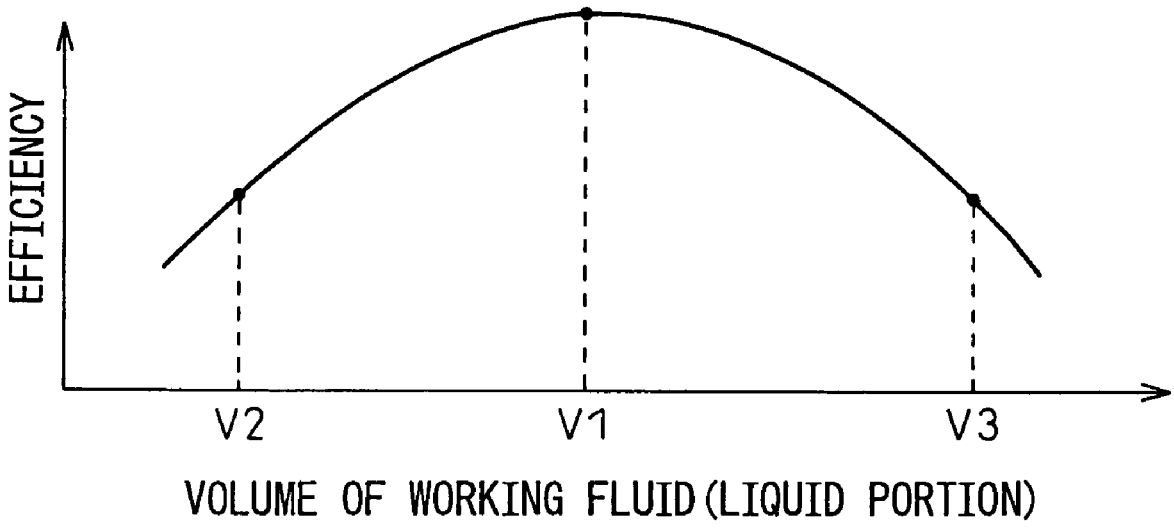
FIG. 5 is a graph showing the relationship between the volume of the working fluid and the efficiency of the external combustion engine.

FIG. 5 is a graph showing the relationship between the volume of the liquid portion of the working fluid 12 and the efficiency of the external combustion engine 10. Though not shown, the relationship between the volume of the liquid portion of the working fluid 12 and the output of the external combustion engine 10 is similar to the relationship shown in FIG. 5.

As understood from FIG. 5, the performance of the external combustion engine 10 reaches the maximum in the case where the liquid portion of the working fluid 12 reaches a predetermined volume V1. In this case, the PV diagram is as shown in FIG. 3A.

In the case where the liquid portion of the working fluid 12 has a volume V2 smaller than the predetermined volume V1, on the other hand, the PV diagram as shown in FIG. 3B is obtained, and the performance of the external combustion engine 10 is decreased. In the case where the volume of the liquid portion of the working fluid 12 is V3 and larger than the predetermined volume V1, the PV diagram is as shown in FIG. 3C, and the performance of the external combustion engine 10 is decreased.

In view of this, according to this embodiment, when the external combustion engine 10 is in operation, the average value Pca of the main container internal pressure Pc is controlled toward the target value PcO thereby to suppress the performance reduction of the external combustion engine 10 which otherwise might be caused by the change in the saturated vapor pressure Ps1 or the change of the peak value Pc1 of the main container internal pressure Pc.

The average value Pca of the main container internal pressure Pc is defined by a value during the self-excited vibration of the liquid portion of the working fluid 12 for one period. The target value PcO, on the other hand, is defined as a value approximated to the average value (FIG. 3A; hereinafter referred to as the ideal average value) Pci of the main container internal pressure Pc in the ideal state where the performance of the external combustion engine 10 is highest, i.e. the state in which the peak value Pc1 of the main container internal pressure Pc is lower than the saturated vapor pressure Ps1 of the working fluid 12 at the heated portion temperature T1 and as near to the saturated vapor pressure Ps1 as possible.

Figure 6:
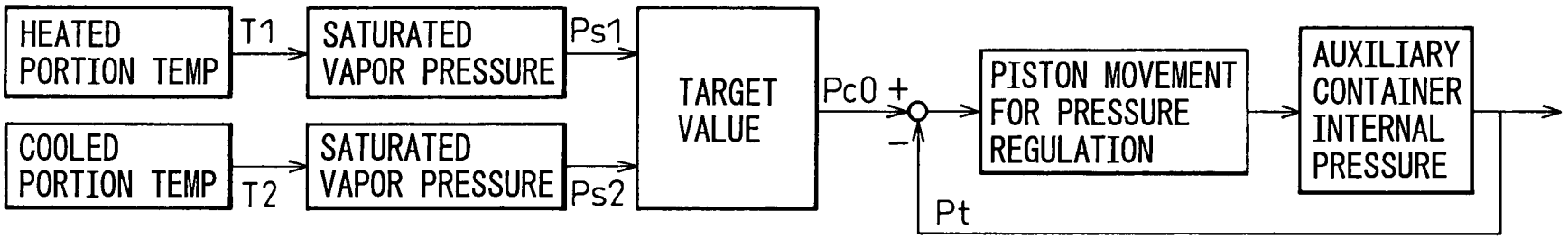
FIG. 6 is a block diagram showing the outline of the control operation according to the first embodiment.

FIG. 6 is a block diagram briefly showing the control operation according to this embodiment. First, the saturated vapor pressure Ps1 of the working fluid 12 at the heated portion temperature T1 is calculated based on the heated portion temperature T1 and the vapor pressure curve of the working fluid 12 shown in FIG. 7.

Figure 7:
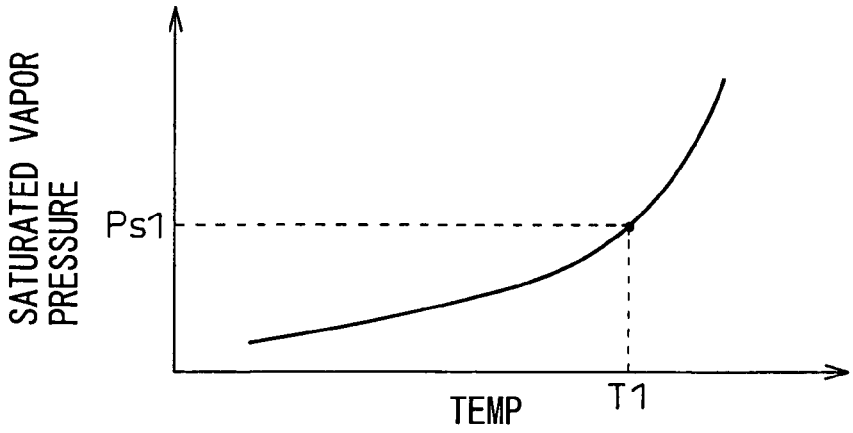
FIG. 7 is a graph showing the vapor pressure curve of the working fluid.

Also, the saturated vapor pressure Ps2 of the working fluid 12 at the cooled portion temperature T2 is calculated based on the cooled portion temperature T2 and the vapor pressure curve of the working fluid 12 shown in FIG. 7. Incidentally, the saturated vapor pressure Ps2 of the working fluid 12 at the cooled portion temperature T2 is equal to the minimum value Pc2 (FIGS. 3A to 3C) of the main container internal pressure Pc during one period.

Next, the target value PcO is calculated based on the saturated vapor pressure Ps1 of the working fluid 12 at the heated portion temperature T1 and the saturated vapor pressure Ps2 of the working fluid 12 at the cooled portion temperature T2. According to this embodiment, the target value PcO is assumed to be the intermediate value between, or more specifically, a value substantially equal to the average value of the saturated vapor pressure Ps1 of the working fluid 12 at the heated portion temperature T1 and the saturated vapor pressure Ps2 of the working fluid 12 at the cooled portion temperature T2.

Since the choke 17*a* is formed in the first connection pipe 17, the auxiliary container internal pressure Pt is prevented from changing with the periodical change of the main container internal pressure Pc, so that the auxiliary container internal pressure Pt is kept stable at a value substantially equal to the average value Pca of the main container internal pressure Pc.

As long as the auxiliary container internal pressure Pt is lower than the target value PcO, the electrically-operated actuator 19*b* pushes out the pressure regulation piston 19*a* to reduce the volume of the auxiliary container 16. As a result, the working fluid 12 in the liquid state is compressed and the auxiliary container internal pressure Pt rises.

In the case where the auxiliary container internal pressure Pt is higher than the target value PcO, the pressure regulation piston 19*a* is pulled in to reduce the volume of the auxiliary container 16. As a result, the working fluid 12 in liquid state is expanded and the auxiliary container internal pressure Pt is reduced.

By adjusting the auxiliary container internal pressure Pt in this way, the average value Pca of the main container internal pressure Pc approaches the target value PcO, or in other words, the ideal average value Pci.

As a result, the external combustion engine 10 can usually be operated under ideal conditions, and therefore, the performance reduction of the external combustion engine 10 which otherwise might be caused by the change in the saturated vapor pressure Ps1 or the change in the peak value Pc1 of the main container internal pressure Pc can be prevented.

In the absence of the choke 17*a* in the first connection pipe 17, the auxiliary container internal pressure Pt would be changed with the periodical change in the main container internal pressure Pc. Unless the period at which the pressure sensor 24 detects the auxiliary container internal pressure Pt is shortened greatly, the average value Pca of the main container internal pressure Pc cannot be calculated accurately.

According to this embodiment, the presence of the choke 17*a* in the first connection pipe 17 can stabilize the auxiliary container internal pressure Pt at substantially the same level as the average value Pca of the main container internal pressure Pc without any change with the periodic change of the main container internal pressure Pc. As a result, the average value Pca of the main container internal pressure Pc can be accurately calculated even in the case where the period at which the pressure sensor 24 detects the auxiliary container internal pressure Pt is long.

The compressibility of a liquid is lower than that of a gas. In the case where the auxiliary container 18 is filled with only the working fluid 12 in the liquid state, the change mount of the auxiliary container internal pressure Pt with respect to the displacement amount of the pressure regulation piston 19*a* excessively increases and the fine adjustment of the auxiliary container internal pressure Pt becomes difficult.

However, according to this embodiment, the auxiliary container 18 is sealed with a gas 18 higher in compressibility than the working fluid 12 in liquid state as well as the working fluid 12 in liquid state. Therefore, the change amount of the auxiliary container internal pressure Pt with respect to the displacement amount of the pressure regulation piston 19*a* can be suppressed. This facilitates the fine adjustment of the auxiliary container internal pressure Pt.

In the configuration described above, assume that the external combustion engine 10 stops with the piston 15 located at other than the bottom dead center. Then, the heater 13 stops heating the working fluid 12 with the vapor of the working fluid 12 existing in the first linear portion 11*e* of the main container 11.

Then, the heated portion temperature T1 gradually drops to the ambient temperature, and with the decrease in the saturated vapor pressure Ps1, the vapor of the working fluid 12 is condensed and liquefied, thereby reducing the main container internal pressure Pc.

Once the main container internal pressure Pc drops below the auxiliary container internal pressure Pt, the working fluid 12 in liquid state in the auxiliary container 16 flows into the main container 11 through the first connection pipe 17, so that the volume of the working fluid 12 in the main container 11 becomes excessive. This phenomenon is likely to occur in winter when the ambient temperature is low.

As long as the volume of the working fluid 12 in the main container 11 of the external combustion engine 10 remains excessive as described above, a predetermined output cannot be produced. However, according to this embodiment, as explained below, the excess of the working fluid 12 in the main container 11 can be quickly returned to the auxiliary container 16 at the time of restarting the external combustion engine 10, and therefore, a predetermined output can be produced quickly after restart.

Specifically, according to this embodiment, the power generator 1 is driven by the power supplied from an external source and the piston 15 passes through the bottom dead center at least once at the time of starting the external combustion engine 10.

With the movement of the piston 15 from top dead center toward bottom dead center, the working fluid 12 in the main container 11 is compressed and the main container internal pressure Pc rises to more than the maximum operating pressure Pcmax.

According to this embodiment, the pressure regulation piston 19*a* is moved to the uppermost position in FIG. 1 to maintain the auxiliary container internal pressure Pt at the minimum level Ptmin at the time of stopping the external combustion engine 10. As a result, the main container internal pressure Pc is increased beyond the auxiliary container internal pressure Pt.

In the absence of the second connection pipe 25, an increase in the main container internal pressure Pc beyond the auxiliary container internal pressure Pt would cause the working fluid 12 in liquid state in the main container 11 to flow into the auxiliary container 16 through only the first connection pipe 17. The presence of the choke 17*a* in the first connection pipe 17 and the resulting fact that only a slight amount of the working fluid 12 in liquid state flows through the choke 17*a* at a time, however, blocks the flow of the working fluid 12. As a result, considerable time would be taken before the excess of the working fluid 12 in the main container 11 returns to the auxiliary container 16 in its entirety.

According to this embodiment, in contrast, an increase in the main container internal pressure Pc beyond the auxiliary container internal pressure Pt opens the check valve 26 arranged in the second connection pipe 25 and the working fluid 12 in liquid state in the main container 11 flows into the auxiliary container 16 through the second connection pipe 25.

In short, according to this embodiment, the main container 11 and the auxiliary container 16 communicate with each other only through the small choke 17*a* in normal operation mode, while the main container 11 and the auxiliary container 16 communicate with each other through the second connection pipe 25 larger in communication area than the choke 17*a* as well as through the choke 17*a* at the time of engine start. As a result, the excess of the working fluid 12 in the main container 11 can be quickly returned to the auxiliary container 16.

If the check valve 26 opens in normal operation mode, the working fluid 12 in liquid state in the main container 11 would flow into the auxiliary container 16 through the second connection pipe 25, with the result that the volume of the working fluid 12 in the main container 11 would be reduced for a reduced performance of the external combustion engine 10.

According to this embodiment, the working pressure ΔP of the check valve 26 is set to a value larger than the difference between the maximum operating pressure Pcmax of the main container internal pressure Pc and the minimum level Ptmin of the auxiliary container internal pressure Pt. In normal operation mode, therefore, the check valve 26 is not opened and the working fluid 12 in the main container 11 is prevented from flowing into the auxiliary container 16 through the second connection pipe 25.

Second Embodiment

Figure 8:
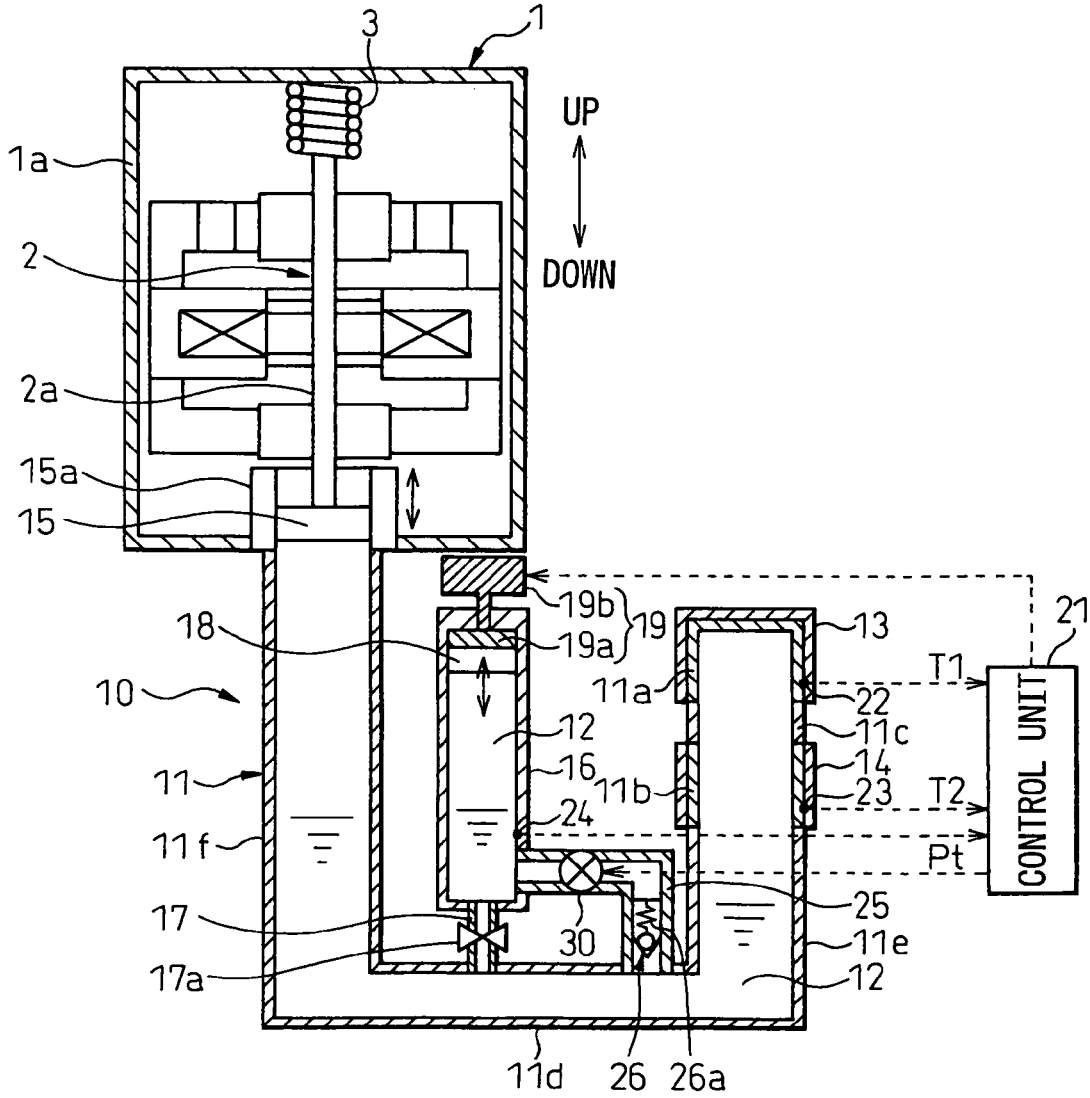
FIG. 8 is a diagram showing a general configuration of a power generating system according to a second embodiment of the invention.

In the second embodiment, unlike in the first embodiment, a valve 30 for opening/closing the second connection pipe 25 is added as shown in FIG. 8. The operation of the valve 30 is controlled by the control unit 21. The valve 30 and the control unit 21, together with the first connection pipe 17, the choke 17*a*, the second connection pipe 25 and the check valve 26, makes up the communication area adjusting means.

The valve 30 is controlled by the control unit 21 to be closed in normal operation mode and open only at the time of starting the external combustion engine 10. Even in the case where the check valve 26 is open in the normal operation mode of the external combustion engine 10, therefore, the working fluid 12 is prevented by the valve 30 from flowing into the auxiliary container 16 through the second connection pipe 25.

As a result, unlike in the first embodiment, the operating pressure ΔP of the check valve 26 is not required to be set to a value larger than the difference between the maximum operating pressure level Pcmax of the main container internal pressure Pc and the minimum level Ptmin of the auxiliary container internal pressure Pt.

According to this embodiment, the operating pressure ΔP of the check valve 26 is set to a level higher than zero but not higher than the difference between the maximum operating pressure Pcmax of the main container internal pressure Pc and the minimum level Ptmin of the auxiliary container internal pressure Pt ($0<\Delta P\leqq Pcmax-Ptmin$).

In the first embodiment, the check valve 26 is not opened at the main container internal pressure Pc not higher than the maximum operating pressure Pcmax, and therefore, the power generator 1 is required to be driven with a large drive power at the time of stating the external combustion engine 10.

However, according to this embodiment, the check valve 26 is opened at the main container internal pressure Pc larger than the auxiliary container pressure Pt but not higher than the maximum operating pressure Pcmax, and therefore, as compared with the first embodiment, the driving force of the power generator 1 at the time of starting the external combustion engine 10 can be reduced. As compared with the first embodiment, therefore, the external combustion engine can be started easily.

Third Embodiment

Figure 9:
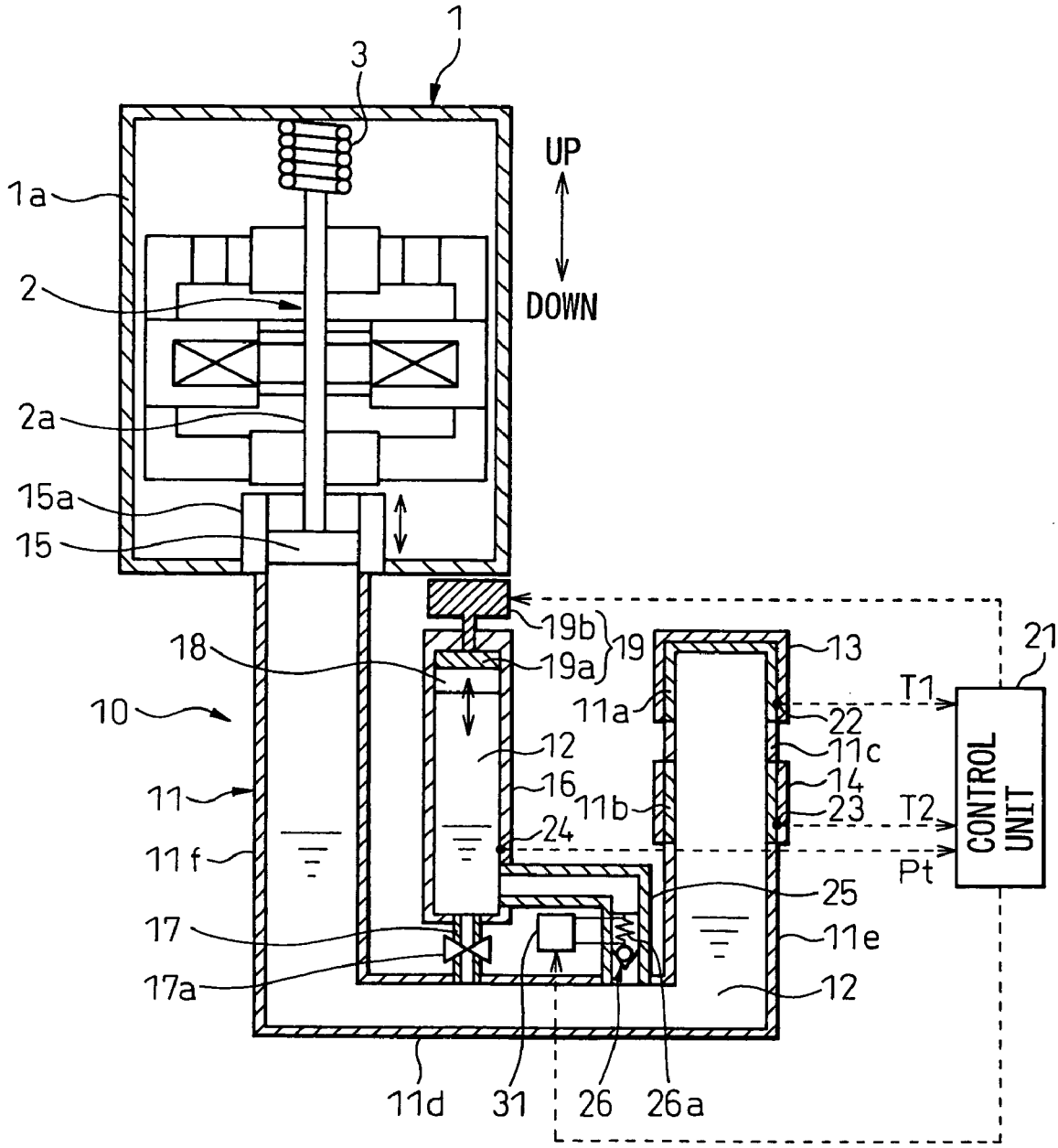
FIG. 9 is a diagram showing a general configuration of a power generating system according to a third embodiment of the invention.

According to the third embodiment, unlike in the first embodiment, the operating pressure ΔP of the check valve 26 can be controlled variably as shown in FIG. 9.

Specifically, the spring portion 26*a* of the check valve 26 is formed of a shape memory alloy or bimetal so that the spring constant of the spring portion 26*a* changes with temperature. Further, the operating pressure ΔP of the check valve 26 changes in accordance with the change in the spring constant of the spring portion 26*a*. Alternatively, the spring portion 26*a* may not have such a characteristic as to change the spring constant thereof with temperature, but a thermostat adapted to expand/contract with temperature may be provided to change the operating pressure ΔP of the check valve 26.

The spring portion 26*a* is heated by the heater 31 which in turn is controlled by the control unit 21.

According to this embodiment, the heater 31 is configured of an actuator for energizing the spring portion 26*a*, which is heated by Joule heat upon energization.

The heater 31 is controlled by the control unit 21 in such a manner that the operating pressure ΔP of the check valve 26 at the time of starting the external combustion engine is reduced below the operating pressure ΔP of the check valve 26 in normal operation mode.

As a result, the check valve 26 is prevented from opening in the normal operation mode of the external combustion engine 10, while the check valve 26 can be opened even at the main container internal pressure Pc not higher than the maximum operating pressure Pcmax at the time of starting the external combustion engine 10. Thus, the same effects as in the second embodiment are produced.

Fourth Embodiment

Figure 10:
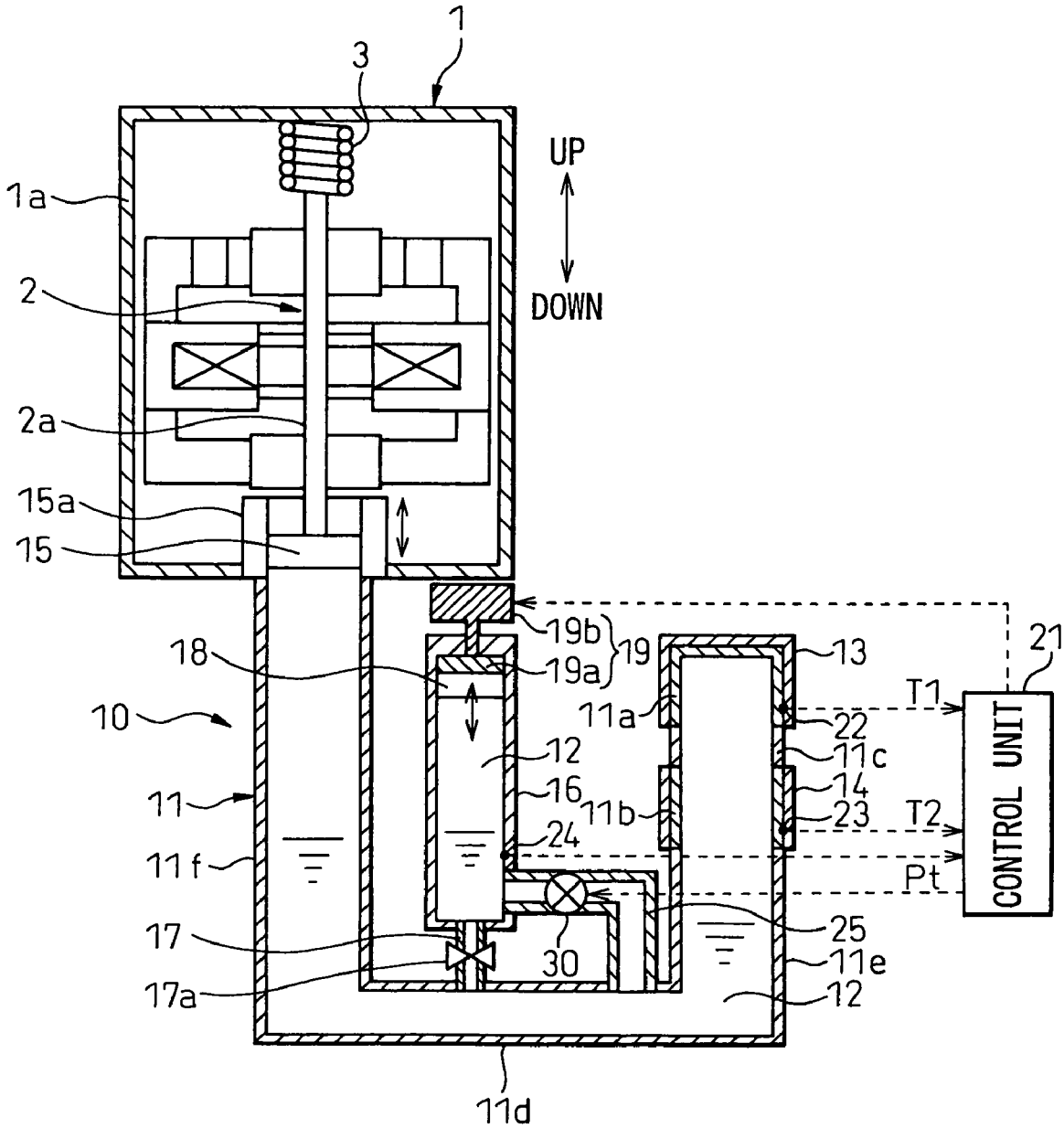
FIG. 10 is a diagram showing a general configuration of a power generating system according to a fourth embodiment of the invention.

According to the fourth embodiment, as shown in FIG. 10, the check valve 26 included in the second embodiment is omitted. The valve 30 is kept open until the piston 15 first reaches the bottom dead center at the time of starting the external combustion engine 10 and closed the instant the piston 15 reaches the bottom dead center for the first time.

Without the provision of the check valve 26, therefore, the working fluid 12 is prevented from flowing into the auxiliary container 16 through the second connection pipe 25 in the normal operation mode of the external combustion engine 10. As a result, the same effects as in the second and third embodiments described above can be produced.

Fifth Embodiment

Figure 11:
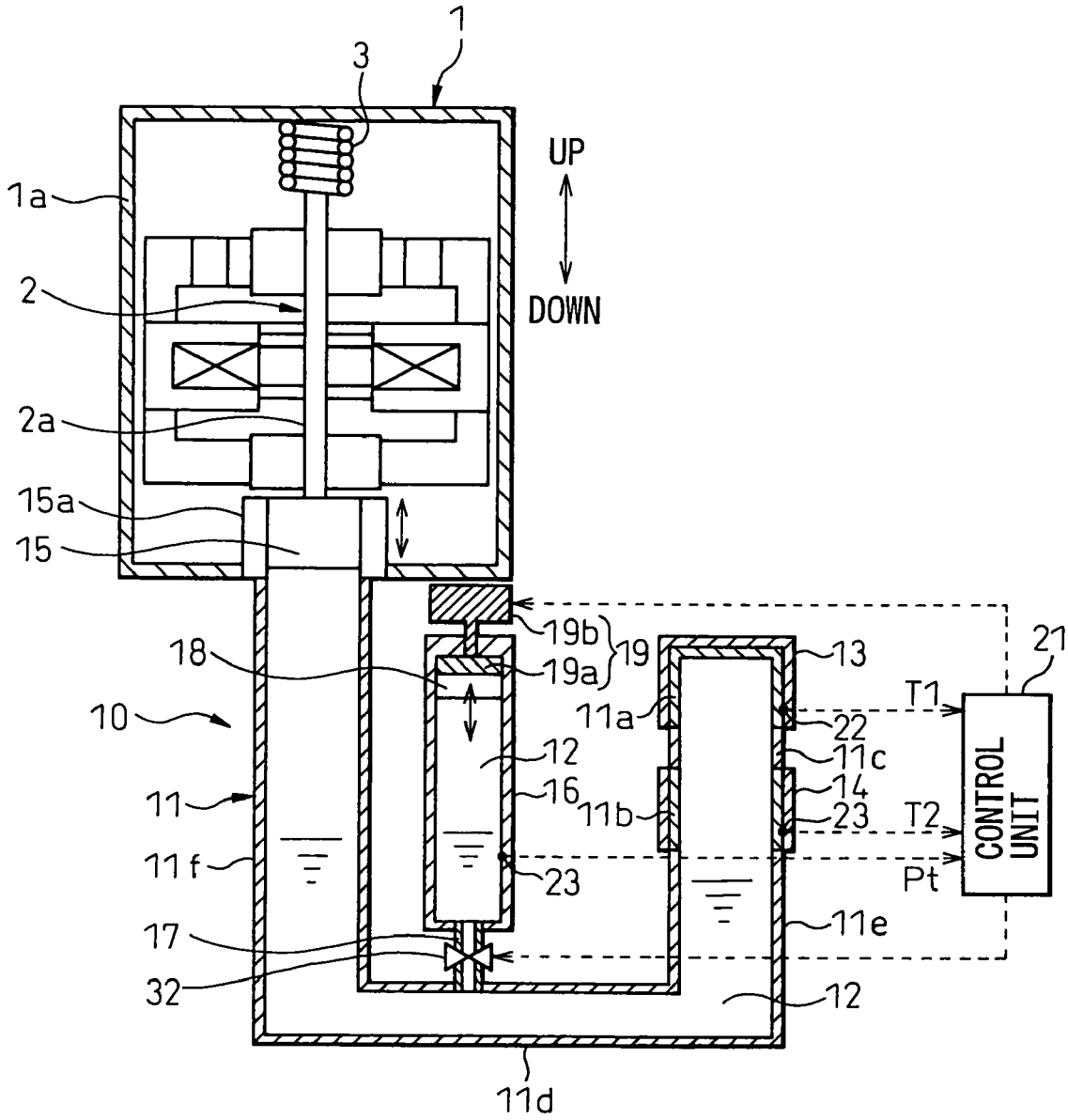
FIG. 11 is a diagram showing a general configuration of a power generating system according to a fifth embodiment of the invention.

According to the fifth embodiment, as shown in FIG. 11, the second connection pipe 25 and the check valve 26 included in the first embodiment are omitted, and the choke 17*a* of the first connection pipe 17 is replaced by an electrically-operated variable choke mechanism 32.

The opening degree of the variable choke mechanism 32 is controlled by the control unit 21 in such a manner as to be larger than in normal operation mode before the piston 15 first reaches the bottom dead center at the time of starting the external combustion engine 10 and reaches the same level as in normal operation mode the instant the piston 15 first reaches the bottom dead center.

As a result, the excess of the working fluid 12 in the main container 11 can be quickly returned to the auxiliary container 16 at the time of starting the engine, while at the same time preventing the working fluid 12 from flowing into the auxiliary container in normal operation mode. Thus, this embodiment exhibits the same effects as the second to fourth embodiments.

According to this embodiment, the first connection pipe 17, the variable choke mechanism 32 and the control unit 21 make up the communication area adjusting means.

Sixth Embodiment

Figure 12:
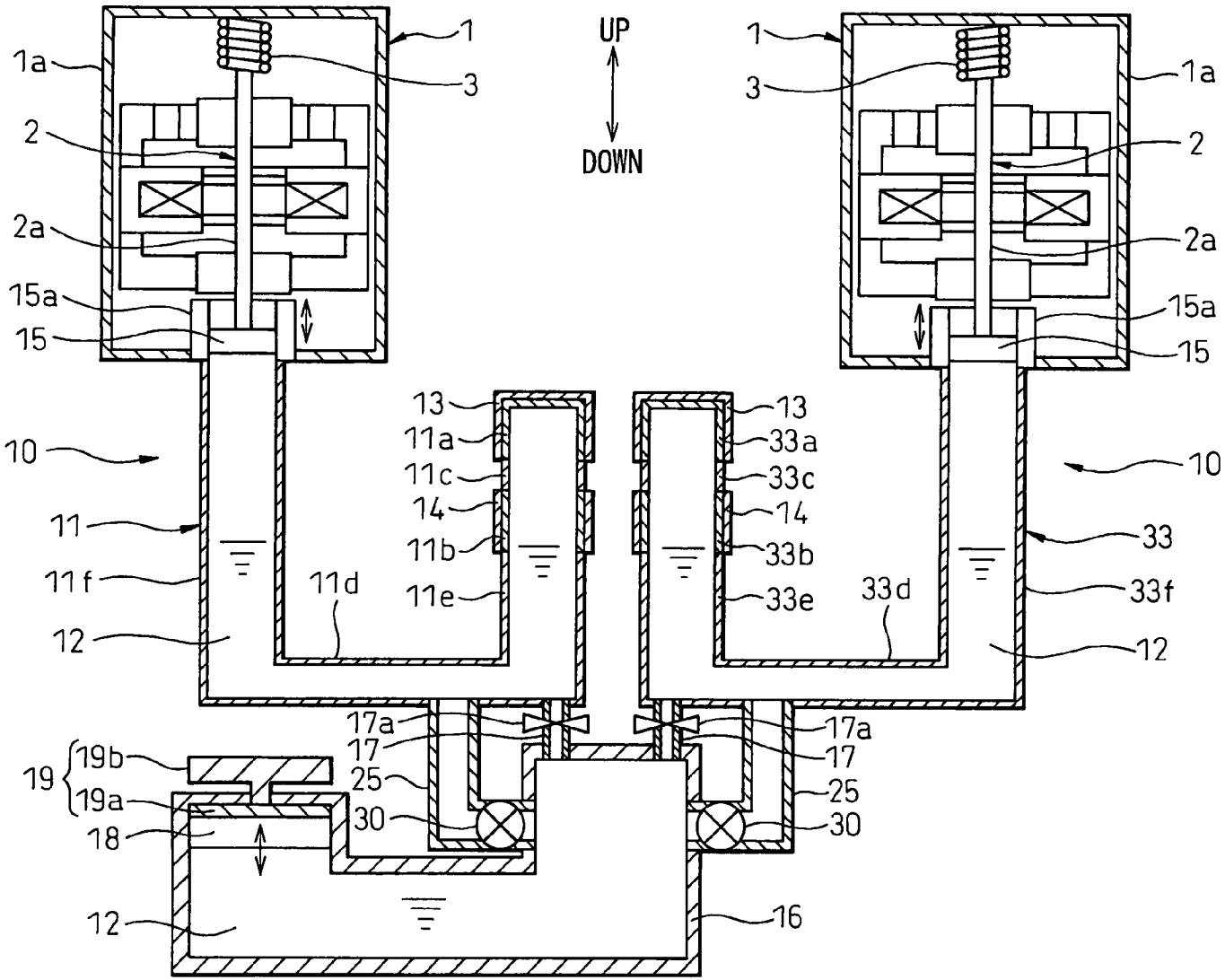
FIG. 12 is a diagram showing a general configuration of a power generating system according to a sixth embodiment of the invention.

The power generating system according to the sixth embodiment, as shown in FIG. 12, includes two external combustion engines 10 of the fourth embodiment. According to this embodiment, these two external combustion engines 10 are designated by the same reference numeral. In FIG. 12, the control unit 21 and the sensors 22 to 24 are not shown for the reason of illustration.

The configuration of the main containers of the two external combustion engines are similar to that of the main container according to each embodiment described above. For convenience the main container of one of the two external combustion engines 10 is referred to as a first container 11 and that of the other external combustion engine 10 as a second container 33.

Incidentally, in FIG. 12, the heated portion, the cooled portion, the intermediate portion, the bent portion and the first and second linear portions of the first container 11 are designated by the same reference numerals as the corresponding parts, respectively, of the main container according to each embodiment described above, while the heated portion, the cooled portion, the intermediate portion, the bent portion and the first and second linear portions of the second container 33 are designated by the reference numerals 33*a* to 33*f*, respectively.

The two external combustion engines 10 are so configured as to have the same target value PcO of the main container internal pressure Pc. Therefore, one auxiliary container 16 is shared by the two external combustion engines 10.

More specifically, only one auxiliary container 16 available communicates with both the first container 11 and the second container 33 through the first connection pipe 17 and the second connection pipe 25, respectively. As a result, the number of the auxiliary containers 16 is reduced for a lower cost.

This embodiment is also applicable to the configuration having three or more external combustion engines 10 with equal effect. Further, this embodiment is of course applicable also to the external combustion engine 10 according to any of the first to the third and fifth embodiments. In the application to the external combustion engine 10 according to the fifth embodiment, the second connection pipe 25 is of course not required.

Seventh Embodiment

Figure 13:
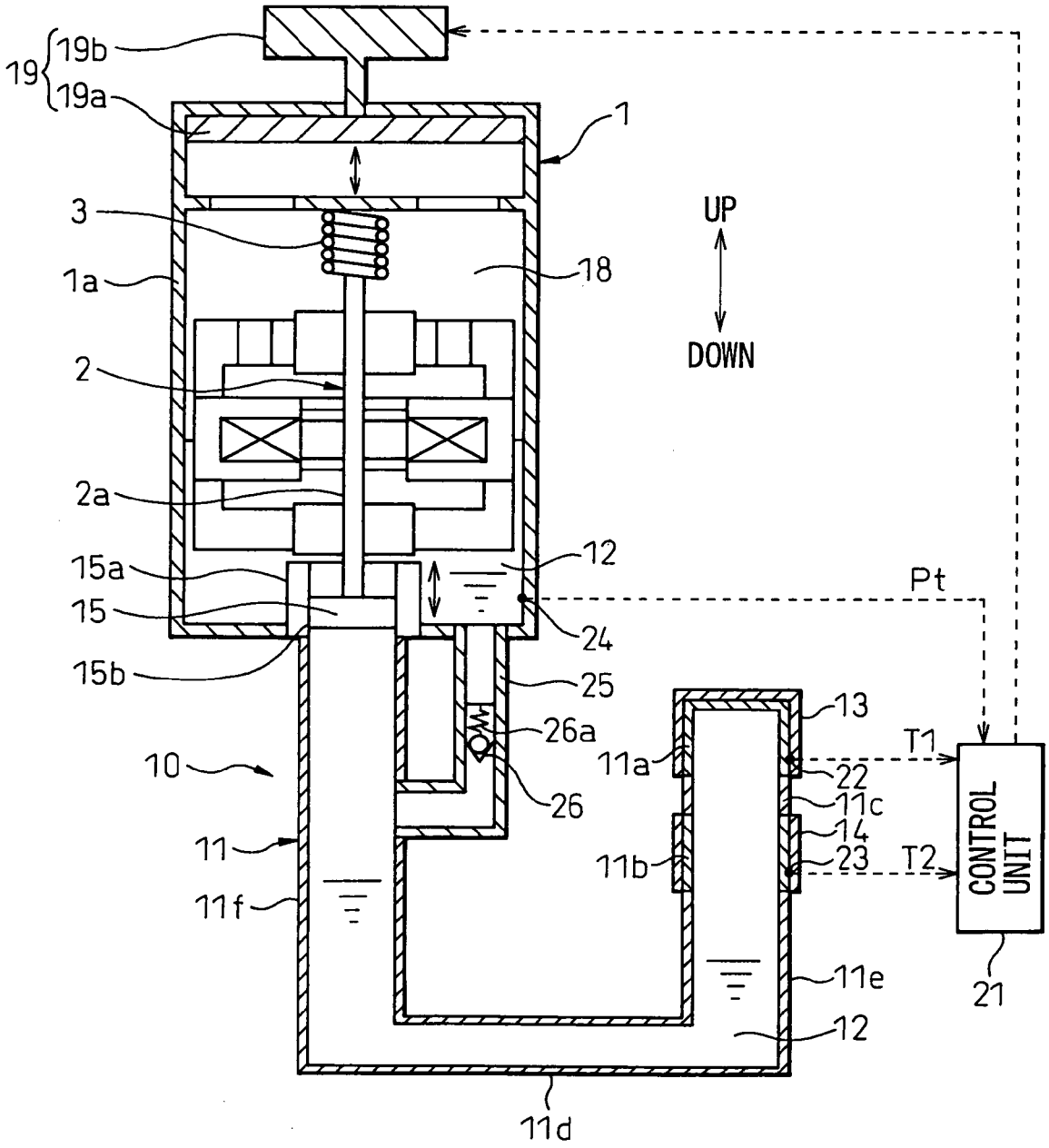
FIG. 13 is a diagram showing a general configuration of a power generating system according to a seventh embodiment of the invention.

According to the seventh embodiment shown in FIG. 13, as compared with the first embodiment described above, the auxiliary container 16 is configured of the power generator 1. More specifically, the working fluid 12 in liquid state and the gas 18 are sealed in the casing 1*a* of the power generator 1, and the piston mechanism 19 for adjusting the auxiliary container internal pressure Pt is arranged above the generator 1. The second connection pipe 25 is arranged between the bottom surface of the casing 1*a* of the generator 1 and the second linear portion 11*f* of the main container 11.

According to this embodiment, the cylinder 15*a* functions as the first connection pipe 17 according to the first embodiment, and the minuscule clearance existing between the piston 15 and the cylinder 15*a* functions as the choke 17*a* according to the first embodiment.

As a result, this embodiment produces the same effects as the first embodiment. Also, according to this embodiment, the auxiliary container 16, the first connection pipe 17 and the choke 17*a* according to the first embodiment are not required. Therefore, both the number of the parts and the cost are reduced.

This embodiment is of course applicable also to the external combustion engine 10 according to the second to fourth embodiments.

Other Embodiments

Although one end of the second connection pipe 25 is connected to the lower part of the auxiliary container 16 and the other end of the second connection pipe 25 to the bent portion 11*d* of the main container 11 according to the first to fourth and sixth embodiments, one end of the second connection pipe 25 may be connected to the portion of the first connection pipe 17 nearer the auxiliary container 16 than the choke 17*a*, and the other end of the second connection pipe 25 to the portion of the first connection pipe 17 nearer the main container 11 than the choke 17*a*.

At the time of starting the engine, therefore, the working fluid 12 in the main container 11 can be introduced into the auxiliary container 16 while bypassing the choke 17*a*. Thus, this configuration produces the same effects as the other embodiments.

Also, in each of the embodiments described above, the main container 11 has a substantially U-shaped configuration. Nevertheless, the main container 11 may alternatively be linear in shape. For example, the linear main container 11 may be arranged vertically, while the heater 13, the cooler 14 and the generator 1 may be arranged in that order top down. In such a case, the auxiliary container 16 is formed to communicate with the portion of the main container 11 nearer the generator 1 than the cooler 14. Also, any configuration can be employed in which the vapor generated by the heater 13 is prevented from reaching the generator 1 by arranging, for example, the heater 13, the cooler 14 and the generator 1 at an angle to the vertical direction or horizontally.

The external combustion engine according to each of the embodiments described, though explained as an application as a drive source of the power generating system, may alternatively be used as a drive source for systems than the power generating system.

While the invention has been described by reference to specific embodiments chosen for purposes of illustration, it should be apparent that numerous modification could be made thereto by those skilled in the art without departing from the basic concept and scope of the invention.

The invention claimed is:

1. An external combustion engine comprising:

a main container containing a working fluid adapted to flow in liquid state;

a heater for heating part of the working fluid in the main container and generating vapor of the working fluid;

a cooler for cooling and liquefying the vapor;

an output unit for outputting by converting the displacement of the liquid portion of the working fluid generated by the volume change of the working fluid due to the generation and liquefaction of the vapor into mechanical energy; and an auxiliary container communicating with the main container;

wherein the heater, the cooler and the output unit are arranged in that order in the direction of displacement of the working fluid;

wherein the auxiliary container containing the working fluid;

wherein the auxiliary container communicates with the portion of the main container nearer the output unit than the cooler;

the external combustion engine further comprising a communication area adjusting means for establishing communication between the main container and the auxiliary container through a first communication area in normal operation mode and establishing communication between the main container and the auxiliary container through a second communication area larger than the first communication area in engine starting mode.

2. The external combustion engine according to claim 1, wherein the communication area adjusting means includes a choke for establishing communication between the main container and the auxiliary container in normal operation mode, and a path larger in flow path area than the choke for establishing communication between the main container and the auxiliary container in starting mode.

3. The external combustion engine according to claim 2, wherein the path has a check valve for allowing the working fluid to flow from the main container to the auxiliary container and blocking the reverse flow of the working fluid from the auxiliary container to the main container.

4. The external combustion engine according to claim 3, wherein the check valve is a spring-type check valve including a spring portion having the spring constant adapted to change with temperature, and the working pressure of the check valve changes with the spring constant, and wherein the spring portion is heated by a heating means controlled by a control means reducing the working pressure in starting mode below the working pressure in normal operation mode.

5. The external combustion engine according to claim 2, wherein the communication area adjusting means includes a valve for opening/closing the path and a control means for controlling the operation of the valve so as to be in a closed state in normal operation mode and to be in an open state in starting mode.

6. The external combustion engine according to claim 1, wherein the communication area adjusting means includes a variable choke mechanism for establishing communication between the main container and the auxiliary container, and a control means for controlling the variable choke mechanism in such a manner as to increase the opening degree of the variable choke mechanism in starting mode beyond the opening degree of the variable choke mechanism in normal operation mode.

7. The external combustion engine according to claim 1, wherein the main container includes a first container, a second container having the same configuration as the first container and only one auxiliary container communicating with both the first container and the second container.

8. The external combustion engine according to claim 1, wherein the output unit includes a casing containing the working fluid, and the casing makes up the auxiliary container.

9. The external combustion engine according to claim 2, wherein the output unit includes a casing containing the working fluid, a cylinder for establishing communication between the casing and the main container and a piston supported slidably in the cylinder and driven by the displacement of the working fluid, wherein the casing makes up the auxiliary container, and wherein a minuscule clearance existing between the piston and the cylinder makes up the choke.

* * * * *